US012782097B2

(12) United States Patent
Boland

(10) Patent No.: US 12,782,097 B2
(45) Date of Patent: Nov. 3, 2026

(54) OPTICAL COMMAND AIRBURST AMMUNITION FUZE SYSTEM

(71) Applicant: John Isaac Boland, Baltimore, MD (US)

(72) Inventor: John Isaac Boland, Baltimore, MD (US)

( * ) Notice: Subject to any disclaimer, the term of this patent is extended or adjusted under 35 U.S.C. 154(b) by 0 days.

(21) Appl. No.: 18/668,202

(22) Filed: May 19, 2024

(65) Prior Publication Data

US 2025/0354789 A1 Nov. 20, 2025

(51) Int. Cl.
*F42C 15/40* (2006.01)
*F42C 13/02* (2006.01)
*F42C 19/06* (2006.01)

(52) U.S. Cl.
CPC ..... *F42C 15/40* (2013.01); *F42C 13/026* (2013.01); *F42C 19/06* (2013.01)

(58) Field of Classification Search
CPC ..... F42C 13/026; F42C 15/40
See application file for complete search history.

(56) References Cited

U.S. PATENT DOCUMENTS 5,196,644 A * 3/1993 Knight ..... F42C 13/026 102/213
5,526,749 A * 6/1996 Teetzel ..... F42B 3/113 102/213
2007/0028791 A1* 2/2007 Bredy ..... F42C 13/026 102/387
2018/0231354 A1* 8/2018 Sullivan ..... F42C 13/047

OTHER PUBLICATIONS

Gilbert, Steve, "Small Arms Grenade Munitions (SAGM)," NDIA Armament Systems Forum, U.S. Army ARDEC, Jun. 3, 2015. Available at: https://ndia.dtic.mil/wp-content/uploads/2015/smallarms/17332_Gilbert.pdf , 10 pages.

Nammo AS, "MPU for 40 mm RF Airburst Ammunition," product webpage, available at: https://www.nammo.com/product/our-products/ammunition/medium-caliber-ammunition/40-mm-products/mpu-for-40-mm-rf-airburst-ammunition/ (accessed Apr. 28, 2026), 3 pages.

Rheinmetall Defence Mission Equipment, "The Vingmate Family—Advanced sight and fire control systems," product webpage, available at: https://www.rheinmetall.com/en/products/electro-optics/observation-and-fire-control-vingmate-family (accessed Apr. 28, 2026)., 10 pages.

* cited by examiner

*Primary Examiner* — J. Woodrow Eldred
(74) *Attorney, Agent, or Firm* — Amsel IP Law PLLC; Jason Amsel

(57) ABSTRACT

A method of airburst fuze configuration by which airburst capability may be retrofitted to existing weapons systems or munitions or configured for new ones. The system consists of a nose or mid-body fuze package for a host projectile, incorporating a rear-looking optical sensor system, which will periscope outwards to establish a rearwards line of sight. The fuze package is to be used with a separate and retained detonation control system which performs fire control calculations and transmits an optical signal at the time airbursting is desired, which subsequently prompts the rear-looking optical sensor to trigger the payload of the host projectile.

20 Claims, 3 Drawing Sheets

OPTICAL COMMAND AIRBURST AMMUNITION FUZE SYSTEM

FIELD

This application pertains to a fuze system for projectiles, to accomplish air bursting by optical command)

BACKGROUND

The need to hit an enemy behind cover is as old as projectile weapons. From the onager and hwacha to mortars and heavy artillery, the challenge of striking a dug-in enemy without line of sight and with minimum exposure of friendly personnel has troubled generations of soldiers and engineers. In modern combat, the high velocity and flat arc of a cannon or grenade launcher can make it impossible to land a shell close behind a wall or in a trench. A mortar, with a high arc allowing it to drop shells onto a target almost vertically, loses accuracy from wind, slight misalignment, and a long flight time. The airburst shell is an excellent solution to both these problems. The airburst removes point-of-impact from the equation. This greatly reduces the role of the ballistic arc in deciding target vulnerability: airburst shells detonate at a floating position along their ballistic path from which the shell has line of sight to the target, allowing the effect of fragmentation and blast to be maximized.

The essential method of accomplishing an airburst is the time delay fuze, pioneered during the Vietnam War by US artillery (tactics known as Killer Junior and Killer Senior) and miniaturized for infantry use most famously in the XM25 CDTE launcher, which was born from the ill-fated XM29 OICW. The XM25—despite the project's termination in 2018—is worth considering in detail: the device consisted of a semi-automatic 25 mm launcher, a smart optic system including a laser rangefinder, and programmable time-fuze grenades. A user would use the integrated laser rangefinder to find the range to a target or to a target's cover, and adjust the detonating range up or down. The launcher would then automatically program the chambered grenade with the resulting range. When fired, the grenade would track its distance by counting the number of rotations it went through, and would then detonate at the appropriate range. On top of that, the XM25 was reported to have four times the effective range of the M203 launcher against point targets (600 m vs 150 m).

The XM25 suffered a number of major drawbacks: the weapon was heavy, at around 14 pounds unloaded, expensive, and suffered from reliability issues requiring costly redesigns. A 2013 production cost estimate predicted $35,000 per launcher and $55 per round (reduced from a reported $1000 per round) around 2015, but the Department of Defense Fiscal Year (FY) 2019 Budget Estimates document lists the per unit cost in FY 2017 as about $67,000, with some reports claiming a cost as high as $93,000 per unit by the time the project was terminated in 2018 after a lawsuit between contractors.

Despite its failure, the XM25 program left us clear evidence of how valuable the airburst capability is. Statements made by US Army sources close to the project provided testimony to its value: a Soldier Weapons assistant product manager reported that their studies indicated that the XM-25 " . . . is 300 percent more effective at incapacitating the enemy than current weapons" and " . . . the XM25, when employed, was a game-changer. We absolutely defeated any enemy force that we deployed the XM25 against. . . . It's a devastating weapon system."

Systems that cannot take advantage of existing components, such as the XM-25, face a logistical barrier to entry even apart from issues of cost. The SAGM (Small Arms Grenade Munitions), developed at the US Army's ARDEC center, addressed this by taking the form of a smart fuze compatible with standard M433 40 mm grenade bodies. The SAGM operates without the need for a pre-programmed airburst range. Instead, the fuze is inferential: using a miniaturized radar, it watches the environment around the grenade as it flies, looking for walls, window frames, and so on, things an enemy could hide behind. Because of this—and its apparent sensitivity to clutter like trees and presumably the wrong wall—a shooter has to be careful to ensure that the grenade doesn't pass by such an obstacle until it reaches its desired target. On the one hand, this means the shooter doesn't have to expose himself before he fires. On the other hand, it makes it much more difficult to actually use the airburst feature, possibly reflected in the Army's claim that the fuze "more than doubles the lethality of the current 40-mm grenade against defilade targets," but the actual effectiveness of the system may only become apparent when the system is used in combat in a cluttered and dirty environment rather than a static range with controlled obstacles and targets.

Besides the sensitivity to clutter like trees making its use in a forest challenging, the total inability to explicitly control which potential cover the SAGM decides to detonate on puts a hard cap on whether it can be a reliable asset. An actual user interface is desirable and necessary for effective airburst ammunition.

NAMMO's 40 mm RF and the Vingmate fire control system from Rheinmetall both return to programmed time airburst, using remote means (radio in the case of NAMMO and infrared pulses in the case of Rheinmetall) to set the fuse once the projectile has left the barrel. This allows for a simpler and less interference-prone system than the SAGM, and can operate in a simpler launcher or with fewer internal modifications to an existing launcher. However, it still requires a complex, large, expensive, and sensitive fuse capable of accurate timekeeping. These systems also emit radio and IR radiation at the start of a projectile's flight. Interception of these signals may not be a significant problem now, but a detectable warning may become undesirable with the proliferation and miniaturization of signals intelligence equipment and unmanned systems (e.g., triggering an incoming fire alarm, warning an active protection system, prompting a small drone to take evasive action or counter-fire, and so on).

The clear solution is command-airburst. Compared to conventional programmed time airburst systems which place complex, sensitive, and expensive timing equipment into the fuze, the command-burst approach moves the required timing components and all electronics other than an optical sensor, signal discrimination component, and supporting architecture from the fuze to a detonation control system (DCS). This reduces the size and weight requirements of the fuze and associated components and allows adjustment of airburst range on-the-fly. The concept of command-burst is not itself new, having been used most famously in Martin Marietta's Sprint ABM which moved at such a high speed that it was superheated and necessarily ablated away, making any on-board sensors pointless, rather it was command-guided to intercept from the ground, including command detonation.

As we have seen, radio command comes with major drawbacks in a tactical context (particularly on the modern battlefield) as radio signals propagate over a wide angle and through many objects. Modern battlefields—land, air, sea, and space—are teeming with radio frequency sensors able to detect emission of a signal, and electronic warfare (EW) assets laboring to jam reception of those signals. With the advent of anti-radar missiles capable of remembering the last location of a transmission and the proliferation of low-cost loitering munitions, emitting a radio frequency signal can be extraordinarily dangerous.

The clear solution is optical command. Optical signals are limited to line of sight (reducing the risk of interception), and optical sensors can be almost entirely directional (reducing the risk of jamming). Such systems have been attempted, but unsuccessfully: U.S. Pat. No. 5,526,749A discloses a laser-initiated projectile that can be initiated by a modified laser range finder at the appropriate time and place. That solution comes with issues: it places its sensor and fuze in the base of the projectile, making it incompatible with existing projectiles which mostly require nose fuzes and therefore requiring a uniquely assembled projectile, with the associated logistical burden in a military context and additional developmental complexity. The base fuze is also inaccessible inside the cartridge case, complicating inspection, reliability, and safety. The base-mounted sensor and fuze configuration also negatively impacts payload performance, taking up the rear arc of the projectile and reducing the fragmentation that can be thrown in that direction: this is a serious shortcoming for a system that must deal with targets behind cover, which may require the projectile to entirely pass a target before detonating.

That a projectile can be command detonated by an optical signal is clear, and can be considered a known part of the art. What is needed is a system that is easy to use, has a method of user interface to allow explicit specification of airburst behavior and performs reliably and predictably in a variety of conditions and situations, but which does not carry with it the heavy logistical requirement of a new, specialized projectile, weapon, or combination thereof, and is instead simple, inexpensive, capable of integration into existing projectiles, weapons, and electronic components (or upon which a purpose-built weapons system can be more easily developed and built), and emits the minimum possible electromagnetic spectrum signature. Further, there is a clear need for a solution to the problems of U.S. Pat. No. 5,526,749A, namely the unique projectile construction, base-mounted sensor and fuze, and their associated developmental, logistical, safety, reliability, and performance problems. A nose or mid-body mounted rear-looking optical sensor has never been attempted because of the previously unsolved issue of the body of the projectile to which the sensor is mounted occluding the sensor's rearward view, preventing receipt of the optical command signal. A solution to this final issue, which achieves all of the aforementioned goals, and a system which can take advantage of the consequent capability, is the object of this application

SUMMARY OF THE INVENTION

This application details an improved system for airbursting explosive projectiles by optical command, which can be readily retrofitted to existing and applied to future weapons and projectiles, comprising two subsystems.

The first subsystem is a rear-looking optical sensor (RLOS) command receiver in communication with or assembled as a fuze, to be mounted as a nose or mid-body fuze, but not base fuze, on some host projectile fired by some host weapon, and configured to look backwards along the flight path of said projectile by extending outwards until said host projectile no longer blocks line of sight to the second subsystem or being brought into line of sight with the second subsystem by the ballistic arc of the host projectile.

The second subsystem is a detonation control system (DCS), in communication with said host weapon, which incorporates user input and sensor data to perform the necessary fire control calculations for activation or detonation of the projectile at a given position, wherein the solution may change with time as in the case of a maneuvering target, and which causes an optical emitter to transmit an appropriate detonation signal to the RLOS. The DCS must be capable of receiving mathematically necessary sensor data to calculate a fire control solution.

Compared to conventional programmed time airburst systems which place complex, sensitive and expensive timing equipment into the fuze, this system moves the required timing components and all electronics other than an optical sensor, signal discrimination component, and supporting architecture from the fuze to the DCS. This reduces the size and weight requirements of the fuze and associated components, and allows for separation of airburst projectile and command unit.

By placing the sensor as a rear-looking nose or mid-body fuze, the system overcomes the safety issues of base fuzes, which are generally hidden inside the cartridge case, making them inaccessible to the end user and so unable to be readily removed or examined. The nose or mid-body fuze configuration further allows existing projectiles which accept nose fuzes to be used as hosts, reducing the logistical footprint and development costs.

The nose or mid-body sensor/fuze further allows the rear of the projectile to be dedicated to explosive/fragmentation payload, greatly improving lethality directly behind the projectile when compared to a base sensor/fuze layout.

That the body of a projectile will occlude an optical sensor, preventing it from having line of sight to the DCS is solved by this system by using a "periscoping device" to extend the sensors or optical components in communication with the sensors a short distance outwards after launch, or analogously by using the driving band or obturator (should the host projectile feature or require the fitting of one), or jacket or section thereof, as the periscoping device by making it out of an optically transmissive material and putting it in communication with the optical sensors. It is also apparent that a sufficiently low-velocity projectile with a relatively high arc will rotate significantly during its flight and so require far less extension of a moving periscoping device than in a high velocity case, in which case a periscoping device need not extend beyond the otherwise occluding geometry at all.

The command detonation approach also brings inherent safety advantages, particularly in urban warfare, reducing the risk from unexploded ordnance and allowing rounds to be commanded to self destruct or simply left to not detonate at all if the operator realizes his shot is endangering civilians or friendly forces once the shot has already been fired.

Additionally, command detonation allows adjustment of airburst range on-the-fly, providing performance similar to proximity fuzes when used in conjunction with target tracking data against targets such as drones, without the drawback of a proximity fuze being unable to definitively distinguish what the user wants it to activate on from any other object it detects within its activation range. This confers a further effectiveness advantage in that the exact time of detonation of the intercepting projectile can be based on far more capable fire control systems than can be fit into a proximity fuze.

This system presents a unique and powerful combination of advantages in technical, logistical, and combat terms.

BRIEF DESCRIPTION OF DRA WINGS

DETAILED DESCRIPTION OF THE INVENTION

Figure 1:
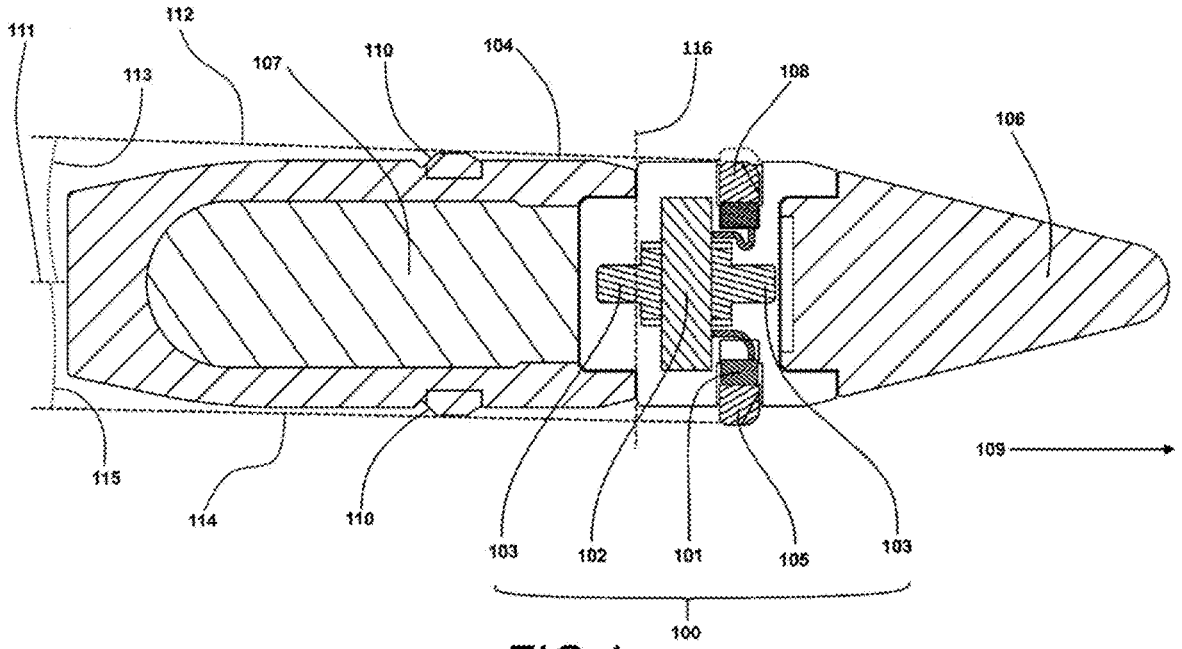
FIG. 1 is a cross-sectional view of a generalized embodiment of a rear-looking optical sensor system assembled into a nose or mid-body fuze mounted to a host projectile.
Figure 2:
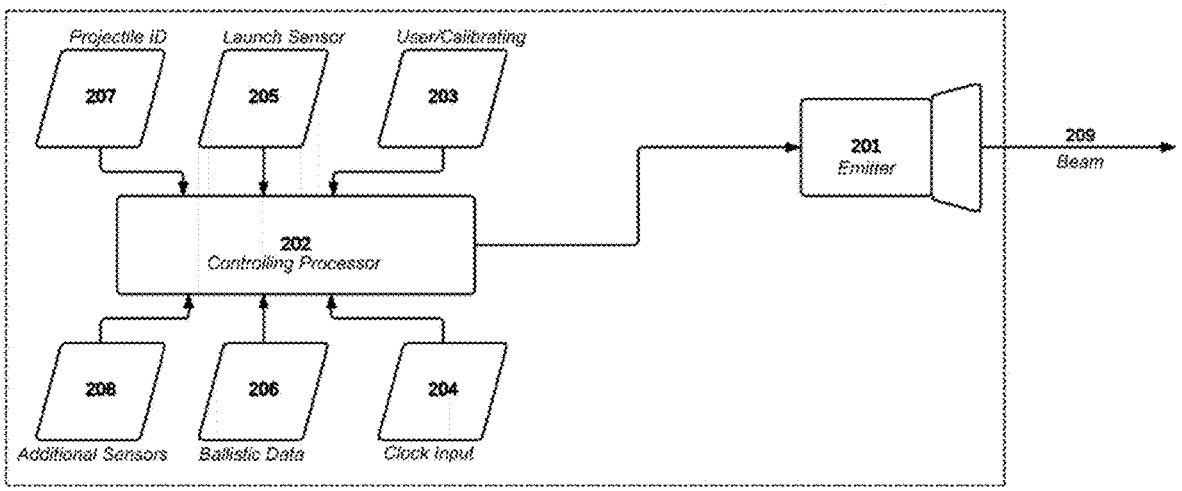
FIG. 2 is a cross-sectional view of a generalized embodiment of a corresponding detonation control system.
Figure 3:
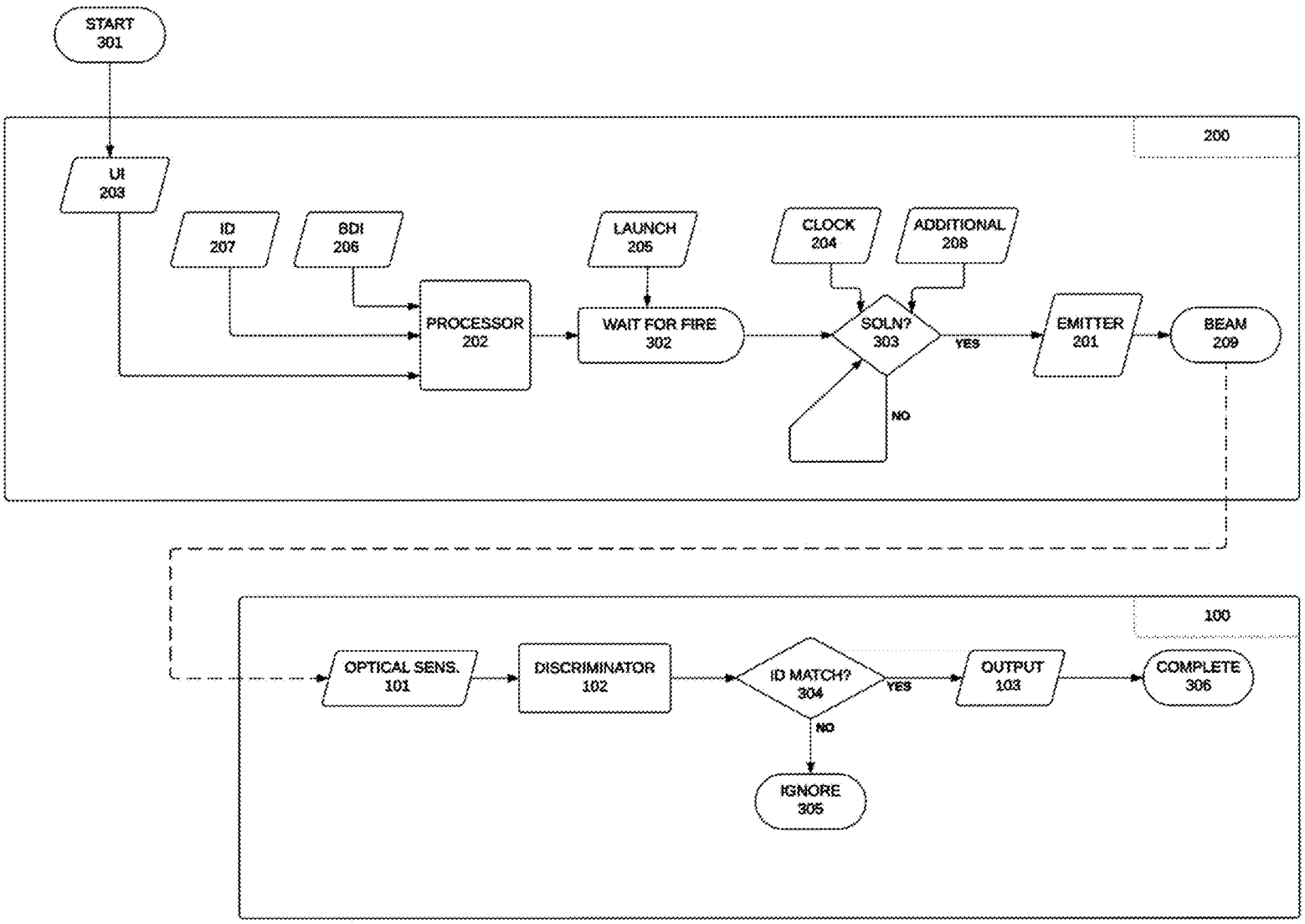
FIG. 3 is a flowchart of the invention as a whole, illustrating the interaction of all components of FIG. 1 and FIG. 2 as a system.
Figure 4:
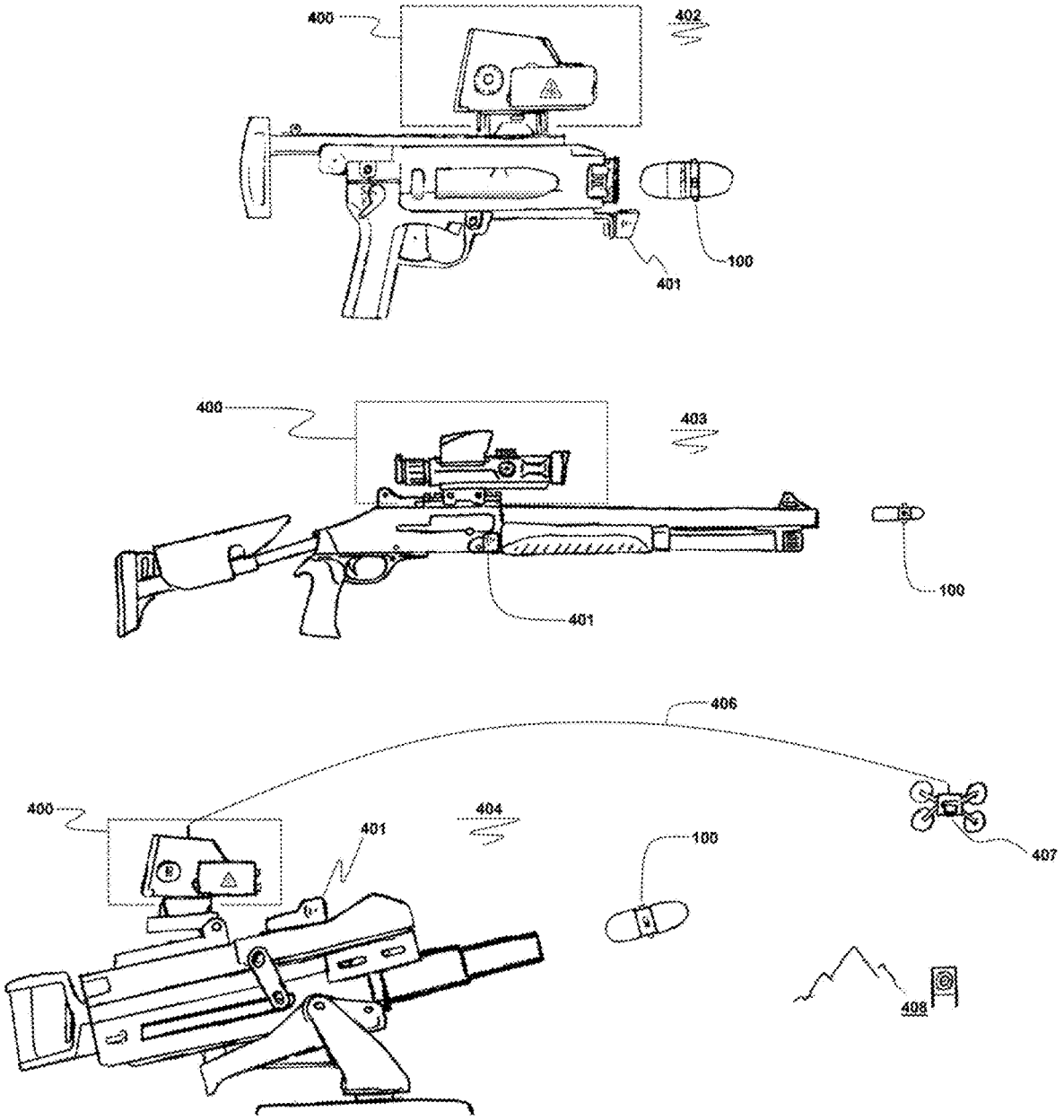
FIG. 4 is a profile illustration of several example embodiments of the invention applied to infantry weapons.

This application details an improved system for command airbursting ammunition by means of optically initiated command detonation, comprising two subsystems, shown respectively in FIG. 1 and FIG. 2. An example of their combined function is shown in FIG. 3. Example embodiments are shown in FIG. 4.

FIG. 1 illustrates the rear-looking optical sensor system mounted to a host projectile. The system is comprised of a rear-looking optical sensor (RLOS) 101 in communication with a signal discrimination component 102, which compares received signals to a desired code or codes stored onboard (stored in flash memory, by an array of band-pass filters, or otherwise). Incorrect codes are ignored, while matching codes prompt activation of an output 103 (such as an electronic detonator or fuze safe-arm device). The output activates the payload (such as an explosive charge, preformed subprojectiles, etc.) of a host projectile 104 to which the entire rear-looking optical sensor system shall be affixed as, with, or as part of a fuze. The RLOS 101, signal discrimination component 102, and at least one output 103 are packaged as part of a fuze package 100, along with corresponding periscoping devices 105 for the RLOS 101 if required. The host projectile 104 is illustrated as a hollow cannon round, which typically accepts a nose fuze such as the fuze package 100 shown, which is shown with dual outputs 103 enabling it to function as either a nose or mid-body fuze. To provide rearwards line-of-sight for the RLOS 101, a periscoping device 105 is included to allow the RLOS to see backwards despite being mounted in the front. This is shown as a simple set of sliding prisms arrayed around the diameter of the projectile with one shown extended as 105 and one shown retracted as 108, though other embodiments might feature different methods of extension, such as flip-out extending arm, mirrors, or an optically transparent driving band. The components of the fuze package 100 (namely the RLOS 101, signal discrimination component 102, one or more outputs 103, and periscoping device or devices 105 and/or 108) may be located anywhere within the body of 100 depending on exact implementation, so long as the RLOS 101 is in communication with the signal discrimination component 102 and periscoping device 105, the signal discrimination component 102 is in communication with the output or outputs 103, said output or outputs are themselves in communication with the host projectile's payload 107, and the periscoping device or devices 105 and/or 108 are exposed to the outside of the fuze and projectile as a whole. A forebody 106 is shown, which may be a component part of the fuze package, incorporated into the fuze package, a explosive-carrying fore-body (if the fuze is configured as a mid-body fuze), a separate impact fuze, or otherwise depending on configuration and needs: it is included for illustrative purposes to demonstrate that the optical sensor system fuze may be mounted as a nose or mid-body fuze and does not preclude the use of additional fuzing. Direction of flight is indicated by arrow 109. The occluding geometry (shown as a driving band or obturator) is labeled as 110, and the closest line of sight along the closest angle from the instantaneous centerline of the projectile 111 is labeled as 112 without any extension of the periscoping device (corresponding to label 108) and as 114 with the periscoping device extended (corresponding to label 105). It is apparent that when there is no radial extension of the periscoping device, the closest line of sight 112 forms a positive angle 113 with the instantaneous centerline of the projectile 111, meaning the RLOS cannot 'see' straight behind the host projectile at any range. It is also apparent that when there is radial extension of the periscoping device beyond the occluding geometry 110, the closest line of sight 114 forms a small negative angle 115 with the instantaneous centerline of the projectile 111, which will eventually cross the centerline at some distance, at which distance the RLOS will naturally be able to see straight behind the host projectile. It is equally apparent that should the ballistic arc of the projectile cause its direction of flight 109 to rotate from its initial value by greater than the value of angle 113, the RLOS will be able to see past the host projectile to the point of launch, and establish line of sight. Thus a nonzero extension of the periscoping device is necessary only for trajectories that are very flat relative to the line of sight angle for non-extended periscoping device 113. Using the driving band or obturator itself 110 as the periscoping device by manufacturing it of optically transmissive material and placing it in communication with the RLOS is functionally identical to the case of the extended periscoping device 105, but without need for a retracted position 108. Therefore this case is included as a specific edge case of the invention which may be particularly beneficial to certain embodiments. Whether the optically transmissive driving band or obturator is mounted to the fuze or to the host projectile adjacent to the fuze (i.e., communicating across plane 116), the function is the same. In the case of projectiles which use their jackets as driving bands or obturators rather than incorporating any obvious protrusions of the same or different material, the jacket should be considered the driving band or obturator as it performs that function.

FIG. 2 illustrates the corresponding detonation control system 200, comprised of an optical emitter 201 (such as a wide-beam laser), in communication with a controlling processor 202 (such as a microcomputer), which itself is configured to communicate with sensors and receive several inputs: there will be a user or calibrating input 203 by which a user operates the system and inputs or adjusts the desired range of activation (e.g., a button to lase a target, buttons or knobs for adjusting set range, etc.). There will be a clock input 204 to allow the processor to count time. There will be a launch sensor input 205 (such as a trigger-activated switch or a recoil sensor) to inform the processor that a projectile has been fired. There will be a ballistic data input 206 to allow the processor to calculate how long a projectile will take to reach the selected activation range. There will be a projectile identifying input 207 (such as a keypad or a near-field RFID scanner) to inform the processor 202 of the correct activation code for the particular rear-looking sensor system and host projectile pair. Lastly, there may be additional sensor inputs 208, which will include any optional enhancing inputs such as atmospheric sensors (to improve fire control solution calculations), or target tracking sensors (e.g. a radar, to allow the fire control solution and thus time of command transmission to be updated 'on the fly' depending on target behavior). The beam 209 from the optical emitter 201 which is received by the optical sensor 101 in FIG. 1 is also shown. The processor 202 performs fire control solution calculations by interpreting the aforementioned inputs, calculating the proper time after firing to transmit, and selecting the proper code to transmit. The processor 202 activates the optical emitter at that time and with that signal, to transmit the correct command to activate the rear-looking optical sensor system at the correct time after launch, and therefore at the correct range. The detonation control system may in whole or in part be integrated or aligned with a host firearm's sighting system, or placed separately to allow activation of the airburst from a position other than that of firing.

FIG. 3 illustrates both the rear-looking optical sensor system and the detonation control system, shown in FIG. 1 and FIG. 2 respectively, together as an example system flowchart. This is to aid in understanding how the components interact, not to limit the possible algorithms and functions of the detonation control system. The same reference characters as in FIG. 1 and FIG. 2 are used, fit into the system flow. The system is started 301, and the process begins within the detonation control system 200. User input is first required 203 is required to set desired range (e.g., by lasing a target). Subsequently the processor 202 computes that information, the projectile ID 207 information, and ballistic data 206 to calculate a firing solution. The system then waits to detect firing 302, which is informed by the launch sensor 205. Once firing has commenced, the system checks for the firing solution to be reached 303. This is informed by the clock input 204 and by any additional inputs 208 (e.g., radar or optical tracking, updated target position, etc). Upon the solution being reached, the emitter 201 outputs the signal via the beam 209. The remainder of the process occurs within the fuze package 100. First, the optical sensor 101 receives the signal from the beam 209. The received signal is then forwarded to the discriminator 102, which identifies whether or not this is the proper signal (or in the event of a multi-function fuze, which signal this is). If the ID matching process 304 returns no, the discriminator does not forward the command. If the signal matching process 304 returns yes, this is forwarded to the output 103, which activates the payload. This completes the system 306.

FIG. 4 is a set of profile views showing an illustrative embodiment of the invention. In this modular embodiment, the detonation control system 200 and all its associated architecture is assembled as a rail-mountable accessory 400 retrofitted to several weapons, in communication with a Radio Frequency Identification reader 401, and the ammunition for which utilize a compact rear-looking optical sensor system fuse package 100—comprised of RLOS 101, signal discriminator 102, and output 103—across host projectiles regardless of caliber and action. These weapons are: a 40 mmLV M320-type grenade launcher 402, a twelve-gauge M1014 shotgun 403, a 40 mmHV Mk 19 automatic grenade launcher 404, which is shown both with its own DCS 405 and with a link 406 to a drone-mounted DCS 407 which is triggering projectiles from the Mk 19 launcher which are fired at a target behind occluding cover 408. These illustrations are not meant to limit the scope of the invention, but to illustrate the adaptability of the system: it is easy to see how it could be applied to the cannon rounds on an anti-missile Close In Weapons System, a countermeasure dispenser on rotary wing aircraft to convert it to a hard-kill active protection system, or even to the cannon rounds of a fighter to defend against head-on missile shots that might otherwise be unavoidable.

I claim:

1. A projectile launchable from a host weapon, comprising:

a payload including an explosive charge; and a fuze package comprising:

a rear-looking optical sensor configured to receive an optical command signal transmitted from a remote optical emitter, wherein the rear-looking optical sensor is positioned forward of at least a portion of the payload along a longitudinal axis of the projectile and has a rearward line of sight during flight of the projectile;

a signal discrimination component configured to determine whether the received optical command signal matches a predetermined command code; and an output element configured to activate the payload in response to a determination that the received optical command signal matches the predetermined command code.

2. The projectile of claim 1, wherein the rear-looking optical sensor comprises a periscope structure that extends outwardly from a body of the projectile to provide the rearward line of sight at a negative or zero angle relative to a centerline of the projectile.

3. The projectile of claim 2, wherein the periscope structure is positioned forward of at least one protruding element of the projectile and extends outwardly to provide the rearward line of sight past the at least one protruding element.

4. The projectile of claim 3, wherein the at least one protruding element comprises at least one of a driving band or an obturator.

5. The projectile of claim 4, wherein the driving band or obturator comprises a material that is separate from a jacket of the projectile.

6. The projectile of claim 4, wherein the driving band or obturator is an integrated component of a jacket of the projectile.

7. The projectile of claim 2, wherein the periscope structure includes an optically transmissive section of at least one of a driving band, an obturator, or a jacket of the projectile.

8. The projectile of claim 1, wherein the optical sensor lacks outward extension from a surface of the projectile, and wherein the rearward line of sight of the rear-looking optical sensor forms a positive angle relative to a centerline of the projectile.

9. The projectile of claim 1, wherein the fuze package is configured as a mid-body fuze.

10. The projectile of claim 1, wherein the fuze package comprises a nose fuze body configured to be disposed at a forward end of the projectile.

11. The projectile of claim 1, wherein the output element is integrated with the rear-looking optical sensor within the fuze package.

12. The projectile of claim 1, wherein the output element is separate from the rear-looking optical sensor and is in communication with the rear-looking optical sensor across an interface plane.

13. A fuze package configured to be attached to a host projectile including a payload having an explosive charge, comprising:

a rear-looking optical sensor configured to receive an optical command signal transmitted from a remote optical emitter, wherein the fuze package is structured to attach to the host projectile such that the rear-looking optical sensor is positioned forward of the payload along a longitudinal axis of the host projectile and has a rearward line of sight during flight of the host projectile;

a signal discrimination component configured to determine whether the received optical command signal matches a predetermined command code; and an output element configured to activate a payload of the host projectile in response to a determination that the received optical command signal matches the predetermined command code.

14. The fuze package of claim 13, wherein the rear-looking optical sensor comprises a periscope structure that extends outwardly from a body of the projectile to provide the rearward line of sight at a negative or zero angle relative to a centerline of the projectile.

15. The fuze package of claim 14, wherein the periscope structure is positioned forward of at least one protruding element of the projectile and extends outwardly to provide the rearward line of sight past the at least one protruding element.

16. The fuze package of claim 15, wherein the at least one protruding element comprises at least one of a driving band or an obturator.

17. An optically commanded airburst system, comprising:

a detonation control system including:

an optical emitter to transmit an optical command signal in response to a host activation signal;

a launch sensor configured to indicate launch of a host projectile that includes a payload having an explosive charge;

a processor to determine an activation time relative to the launch based on ballistic data for the host projectile, and to control the optical emitter to transmit the optical command signal at the activation following detection of the launch;

a fuze package configured to be attached to the host projectile, the fuze package including:

a rear-looking optical sensor configured to receive an optical command signal from the optical emitter, wherein the rear-looking optical sensor is positioned forward of the payload along a longitudinal axis of the projectile and has a rearward line of sight during flight of the projectile;

a signal discrimination component configured to determine whether the received optical command signal matches a predetermined command code;

an output element configured to activate the payload of the host projectile in response to a determination that the received optical command signal matches the predetermined command code.

18. The optically commanded airburst system of claim 17, wherein the rear-looking optical sensor comprises a periscope structure that extends outwardly from a body of the projectile to provide the rearward line of sight at a negative or zero angle relative to a centerline of the projectile.

19. The optically commanded airburst system of claim 18, wherein the periscope structure is positioned forward of at least one protruding element of the projectile and extends outwardly to provide the rearward line of sight past the at least one protruding element.

20. The optically commanded airburst system of claim 19, wherein the at least one protruding element comprises at least one of a driving band or an obturator.

* * * * *